US007231153B2

(12) United States Patent
May

(10) Patent No.: US 7,231,153 B2
(45) Date of Patent: Jun. 12, 2007

(54) SYSTEMS AND METHODS FOR MONITORING REPLACEABLE UNITS

(75) Inventor: Jerome E May, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 261 days.

(21) Appl. No.: 11/034,058

(22) Filed: Jan. 13, 2005

(65) Prior Publication Data

US 2006/0153578 A1 Jul. 13, 2006

(51) Int. Cl.
*G03G 15/00* (2006.01)

(52) U.S. Cl. ..... 399/25; 399/8

(58) Field of Classification Search ..... 399/12, 399/8, 29, 37
See application file for complete search history.

(56) References Cited

U.S. PATENT DOCUMENTS 4,258,095 A 3/1981 Larson et al.
4,496,237 A * 1/1985 Schron ..... 399/81
4,688,026 A 8/1987 Scribner et al.
4,961,088 A * 10/1990 Gilliland et al. ..... 399/25
4,989,754 A 2/1991 Grasso et al.
5,019,869 A 5/1991 Patton
5,085,962 A 2/1992 Aslam et al.
5,112,717 A 5/1992 Baxter et al.
5,182,943 A 2/1993 Fukui et al.
5,200,785 A 4/1993 Hoover et al.
5,223,370 A 6/1993 Sacripante et al.
5,272,503 A 12/1993 LeSueur et al.
5,392,104 A 2/1995 Johnson
5,444,522 A 8/1995 Owens, Jr. et al.
5,452,065 A 9/1995 Bell
5,666,592 A 9/1997 Aslam et al.
5,783,348 A 7/1998 Tyagi et al.
5,784,665 A 7/1998 Bae
5,809,375 A * 9/1998 Owens et al. ..... 399/111
5,884,123 A 3/1999 Stickney et al.
5,942,067 A 8/1999 Newman
5,970,276 A * 10/1999 Kato ..... 399/29
6,009,285 A 12/1999 Barry et al.
6,016,409 A 1/2000 Beard et al.
6,058,279 A 5/2000 Folkins
6,157,898 A 12/2000 Marinelli
6,167,223 A 12/2000 Fiore et al.
6,181,855 B1 1/2001 Richter et al.
6,269,234 B1 7/2001 Kurz et al.
6,295,422 B1 9/2001 Curry et al.
6,332,062 B1 12/2001 Phillips et al.
6,351,621 B1 2/2002 Richards et al.
6,397,015 B2 5/2002 Curry et al.
6,438,329 B1 8/2002 Budnik et al.
6,546,213 B2 4/2003 Ito et al.
6,570,599 B2 5/2003 Jacob et al.
6,654,569 B2 11/2003 Nozawa
6,668,152 B1 12/2003 Jacob
6,735,399 B2 5/2004 Tabb et al.

(Continued)

*Primary Examiner*—Anjan Deb
(74) *Attorney, Agent, or Firm*—Oliff & Berridge, PLC

(57) ABSTRACT

Systems and methods for monitoring a replaceable component of a device may include a monitor located on the replacement component. The monitor may include a controller, a memory, and a first communicator that communicates with a second communicator in the device. The monitor may further include a sensor on the monitor that is capable of sensing at least one property of the replaceable component and/or the contents of the replaceable component. The monitor may include a parasitic power generator.

19 Claims, 6 Drawing Sheets

U.S. PATENT DOCUMENTS

| | | | | |
|---|---|---|---|---|
| 6,738,903 | B1 | 5/2004 | Haines | |
| 6,792,218 | B2 * | 9/2004 | Tungate et al. | 399/29 |
| 7,062,181 | B2 * | 6/2006 | Buchheit | 399/24 |
| 2002/0028081 | A1 | 3/2002 | Ito et al. | |
| 2002/0094207 | A1 * | 7/2002 | Richards et al. | 399/8 |
| 2003/0059050 | A1 | 3/2003 | Hohberger et al. | |
| 2003/0215245 | A1 * | 11/2003 | Silence et al. | 399/8 |
| 2003/0215247 | A1 | 11/2003 | Beard et al. | |
| 2007/0047974 | A1 * | 3/2007 | Tanaka | 399/8 |

* cited by examiner

SYSTEMS AND METHODS FOR MONITORING REPLACEABLE UNITS

INCORPORATION BY REFERENCE

Co-pending U.S. Pat. Nos. 7,146,112 and 7,062,181, and U.S. Patent Publication Nos. 2006-0133609, 2006-0179391, 2006-0133831, 2006-0132287, 2006-0136989 and 2006-0133828 are herein incorporated by reference in their entirety.

BACKGROUND

1. Related Technical Fields

Related fields generally include the utilization of commonly replaced system parts. Related fields include Customer Replaceable Units (CRU) and Customer Replaceable Unit Monitors (CRUM).

2. Description of Related Art

Many machines have replaceable sub-assemblies. Printing machines, for example, may have a number of replaceable sub-assemblies such as a fuser print cartridge, a toner cartridge, or an automatic document handler. These subassemblies may be arranged as unit called a cartridge, and if intended for replacement by the customer or machine owner, may be referred to as a CRU. Examples of a CRU may include a printer cartridge, a toner cartridge, or a transfer assembly unit. It may be desirable for a CRU design to vary over the course of time due to manufacturing changes or to solve post-launch problems with either the machine, the CRU, or a CRU and machine interaction. Further, design optimizations may be recognized subsequent to design launch and machine sale that a relatively simple code update might realize. However, solving these problems, or providing optimization updates, generally requires a field service call to accomplish.

U.S. Pat. No. 4,496,237 to Schron discloses a reproduction machine having a non-volatile memory for storing indications of machine consumable usage such as photoreceptor usage, exposure lamp usage, and developer usage, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the display. In this manner, the status of various consumables can be monitored and appropriate instructions displayed for replacement. In another feature, the same information on the alphanumeric display can be remotely transmitted.

In U.S. Pat. No. 4,961,088 to Gilliland et al., there is disclosed a monitor/warranty system for electrostatographic reproducing machines in which replaceable cartridges providing a predetermined number of images are used, each cartridge having an EEPROM programmed with a cartridge identification number that when matched with a cartridge identification number in the machine enables machine operation, a cartridge replacement warning count, and a termination count at which the cartridge is disabled from further use, the EEPROM storing updated counts of the remaining number of images left on the cartridge after each print run.

U.S. Pat. No. 5,272,503 to LeSueur et al. provides a printing machine, having operating parameters associated therewith, for producing prints. The printing machine includes a controller for controlling the operating parameters and an operator replaceable sub-assembly adapted to serve as a processing station in the printing machine. The operator replaceable sub-assembly includes a memory device, communicating with the controller when the replaceable sub-assembly is coupled with the printing machine, for storing a value which varies as a function of the usage of the replaceable sub-assembly, the controller adjusting a selected one of the operating parameters in accordance with the stored value for maintaining printing quality of the printing machine.

U.S. Pat. No. 6,016,409 to Beard et al. discloses a fuser module, being a fuser subsystem installable in a xerographic printing apparatus, which includes an electronically readable memory permanently associated therewith. The control system of the printing apparatus reads out codes from the electronically-readable memory at install to obtain parameters for operating the module, such as maximum web use, voltage and temperature requirements, and thermistor calibration parameters.

U.S. Patent Publication No. 2003/0215247 relates to a method for operating a machine using at least a first replaceable sub-assembly and at least a second replaceable sub-assembly. The method comprising the steps of providing the first replaceable sub-assembly with a memory, the memory having stored within it a software code upgrade of executable instructions relating to the utilization of the second replaceable sub-assembly. This is then followed with placing the first replaceable sub-assembly into the machine, reading the memory and placing the stored software code upgrade of executable instructions into the machine as new machine software code. The next step is operating the machine with the second replaceable sub-assembly in accordance with the new machine software code. In particular, U.S. Patent Publication No. 2003/0215247 relates to a method for operating a printer apparatus comprising the step of providing a first CRU separable from the printer apparatus, the first CRU further comprising a memory, the memory having stored within a software code upgrade of executable instructions relating to the utilization of a second CRU.

All of the references indicated above are herein incorporated by reference in their entirety for their teaching.

SUMMARY

A particular problem arises when a CRU, for example, a marking material dispenser, must rotate during operation. When the CRU rotates, a CRUM affixed to that CRU must also rotate. The typical CRUM either has a wired connection to a transmitter and/or receiver, or has a fixed wireless communication distance with a transmitter and/or receiver. Thus, as a wired CRUM rotates, a wired connection may become wrapped around the CRU to which the CRUM is attached. As a result, the wired connection must be long enough to allow for a large number of rotations. This presents significant design problems including, for example, requiring a user to connect the wired CRUM to the device in which it is installed, as well as preventing tangling and/or disconnection of the wired connection.

As a wireless CRUM rotates, it may move further away from a stationary transmitter and/or receiver and out of range of the typical wireless CRUM communication distance. The wireless CRUM is only capable of communication when within a communication distance of the wireless receiver and/or transmitter. Thus wireless CRUM communication may only be realized when the rotating CRUM passes by the transmitter and/or receiver during rotation. As a result, the wireless CRUM may be out of communication for a significant portion of the CRU's rotation.

Because the typical wireless CRUM may be out of communication for a significant portion of the CRU's rotation, information that is to be transmitted to the CRUM must be stored by a transmitter until the CRUM is within the communication distance. Similarly, information that is to be transmitted by the CRUM must be stored by the CRUM until it is within the communication distance. This causes a number of design inconveniences. First, both the CRUM and transmitter must have enough memory to store the information to be transmitted while out of communication range. Second, once the CRUM moves within the communication distance of the transmitter and/or receiver, the rotation of the CRU may have to be paused in order to allow a large amount of stored information to be transmitter and/or received. This may slow the overall operation of the device in which the CRU is installed. Third, if a user inserts an incorrect CRU into the device, the device may not become aware of the incorrect CRU until the CRUM on the incorrect CRU comes within the communication distance of the transmitter and/or receiver.

Accordingly, various exemplary implementations provide a system for monitoring a replaceable rotating component of a device, including a monitor located on the replaceable rotating component. The monitor may include a controller, a memory, and a first communicator that communicates with a second communicator in the device. The monitor may be located on the replaceable rotating component such that the first communicator is within a communication distance of the second communicator during an entire rotation of the replaceable rotating component.

The replaceable rotating component of the device may include a non-rotating portion and a rotating portion. The non-rotating portion may be fixed to the rotating portion and the monitor may be located on the non-rotating portion.

Various exemplary implementations provide a method of monitoring a replaceable rotating component of a device, including locating a monitor on the replaceable rotating component. The monitor may include a controller, a memory, and a first communicator that communicates with a second communicator in the device. The monitor may be located on the replaceable rotating component such that the first communicator is within a communication distance of the second communicator during an entire rotation of the replaceable rotating component.

When the replaceable rotating component of the device includes a non-rotating portion and a rotating portion with the non-rotating portion fixed to the rotating portion, the method may include locating the monitor on the non-rotating portion.

Another problem that arises within the typical CRU-CRUM relationship is that an incorrect CRUM may be associated with a CRU. A typical CRUM only has data storage and data transmission functions. The typical CRUM is incapable of sensing its environment. Thus, if an incorrect CRUM is associated with a CRU, the device containing the CRU will continue to operate as if the CRU is correct, which may cause damage to the device and/or output of the device in which the CRU is installed.

Accordingly, various exemplary implementations provide a sensor on the monitor that is capable of sensing at least one property of the replaceable component and/or contents of the replaceable component and/or its operating environment.

Another problem arises in that many devices that utilize CRUs are not designed to utilize and/or communicate with CRUMs. Such devices are unable to power CRUMs and are unable to communicate with CRUMs. Accordingly, various, exemplary implementations provide a monitor that need not communicate with a device in which it is installed and may generate its own power.

DETAILED DESCRIPTION OF EXEMPLARY IMPLEMENTATIONS

Figure 1:
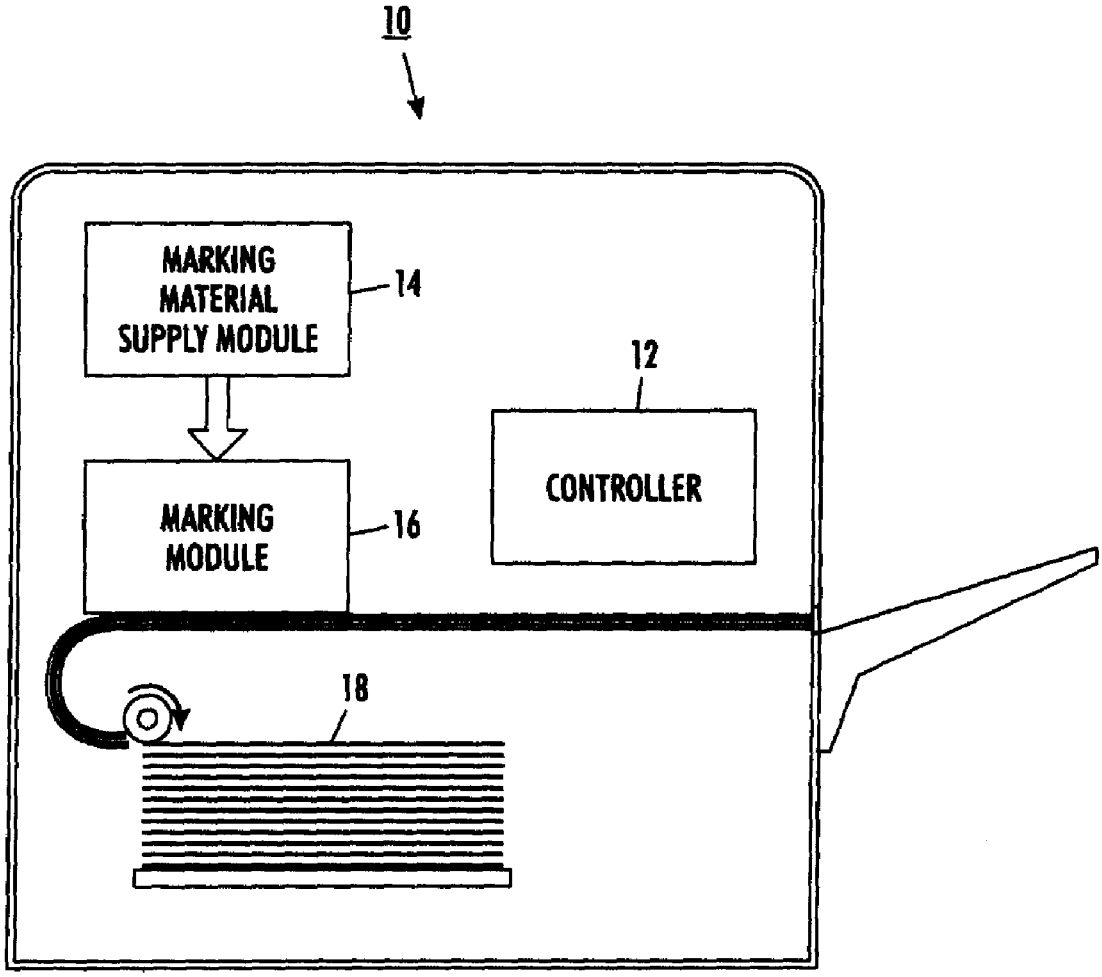
FIG. 1 depicts a schematic representation of an exemplary device with a CRU.

FIG. 1 is an elevational view showing representational elements of a an exemplary device that utilizes CRUs, such as, for example a digital printer of the ink jet or "laser" (electrophotographic or xerographic) variety, or a digital or analog copier. The device, which will herein be referred to generally as printer 10, may be physically, conceptually and/or functionally divided into a controller 12, as well as a marking material supply module 14 and a marking module 16 (e.g., CRUs). Sheets of media (sheets) on which images may be printed may be drawn from a stack 18 and may move relative to the marking module 16, where the individual sheets may be printed upon with desired images.

The marking material for placing marks on various sheets by the marking module 16 may be provided by the marking material supply module 14. Typically, if the printer 10 is of the xerographic variety, the marking material module 14 includes a supply of toner and may include separate tanks for different primary-colored inks, while the marking module 16 includes any number of hardware items for the xerographic process, such as a photoreceptor and/or fusing device. In the ink-jet context, the marking material module 14 typically includes a quantity of ink (e.g., solid or liquid), while the marking module 16 includes a printhead. In order to provide the marking module 16 with marking material, the marking material supply module 14 may be formed as one or more marking material supply containers which may rotate. The rotation of the container causes marking material to be expelled from the marking material supply module 14 into the marking module 16.

Of course, depending on a particular design of a device, the functions of modules 14, 16 may be combined into a single module, or alternately, the marking device may not be provided in an easily replaceable module such as 16. Further, there may be provided several separate marking material modules 14, such as in a full color printer. What is significant, is that there simply be provided one or more CRUs associated with the device 10. As discussed above, in the current market for such devices, it is typically desirable that such modules such as 14 or 16 be readily replaceable by the end user, thus saving the expense of having a representative of the vendor visit the user.

Figure 2:
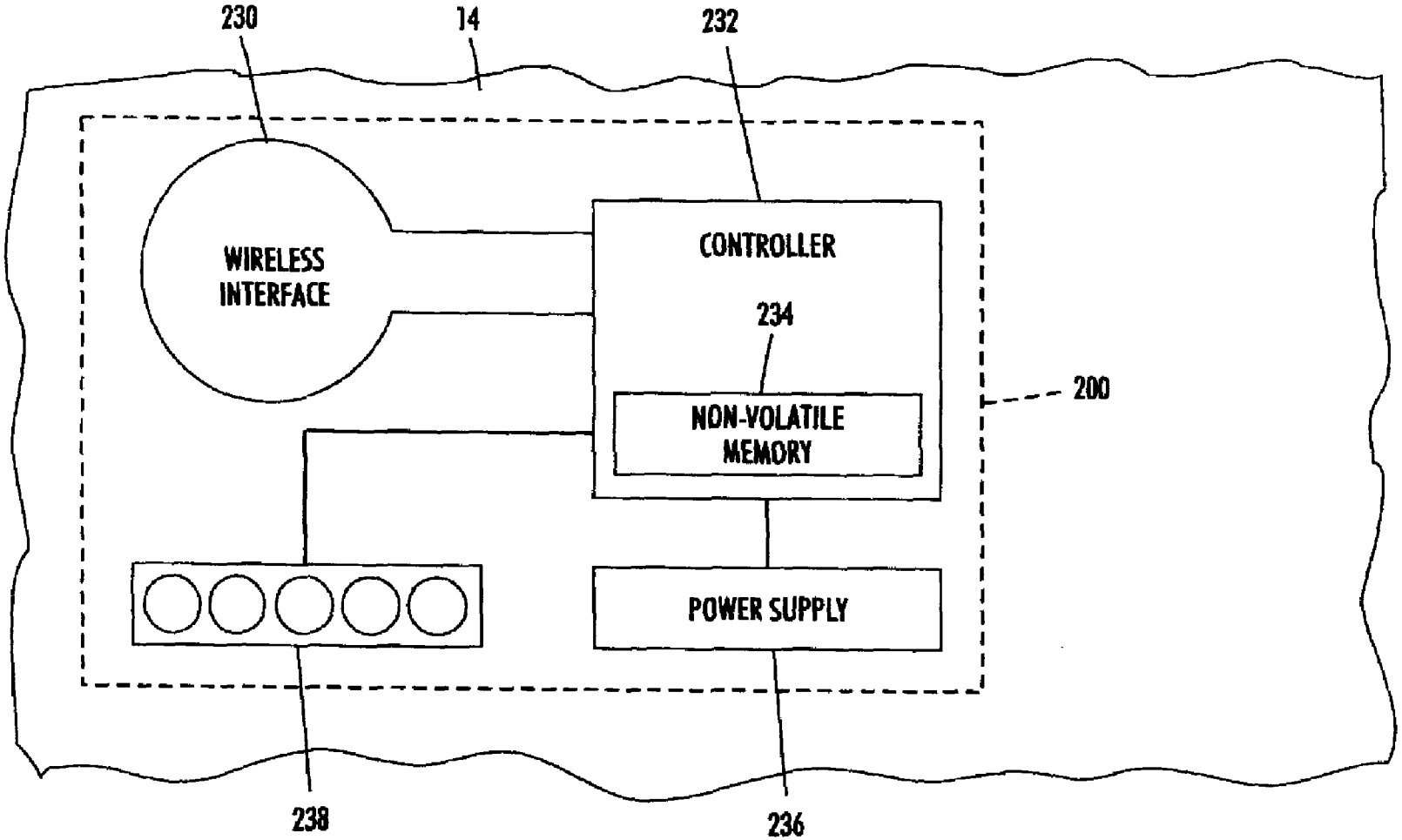
FIG. 2 is a simplified view showing various exemplary elements of a CRUM operable through wireless means.

FIG. 2 is a simplified view showing the various elements of a CRUM 200 operable through wireless means. The CRUM 200 may be permanently or removably attached to a surface either on the outside or the inside of a particular rotating module, such as the marking material supply module 14, a portion of such a surface being shown in FIG. 2. In order to operate through wireless means, the CRUM 200 requires a wireless interface 230, such as, for example, an RF loop (along with associated circuitry, the nature of which is well known), although other wireless interfaces, such as an infrared detector, an ultrasound or acoustical transmitter and detector, or some other optical or electromagnetic coupling, may be provided.

The wireless interface 230 may be associated with a controller 232. This controller 232 may include circuitry that acts as an interface between the wireless interface 230 and, for example, a non-volatile memory 234. The non-volatile memory 234 may be disposed within the controller 232, but is here shown separately for clarity. The wireless interface 230 may be formed as an etched loop aerial as part of, for example, a circuit board forming the CRUM 200. The controller 232 may also have associated therewith, for example, a power supply 236, the exact nature of which will depend on the specific design. The controller 232 may include circuitry for recognizing and processing wireless signals of a particular type, which may be detected by the wireless interface 230. The controller 232 may further be provided with a physical interface 238, such as a wired interface, which could be adapted to interact with circuitry within the device in which the associated CRU is installed (such as in the case of a wired CRUM). It should be appreciated that only one of the wireless interface 230 or the physical interface 238 is needed, but both may be included.

The wireless operation of a CRUM associated with a module, such as 14 or 16, may also work in various ways. The detection of a suitable wireless signal on the wireless interface 230 by the controller 232 may cause the controller 232 to read out all data relating to the CRUM that is stored in the non-volatile memory 234 at any given time. This data from the memory 234 either may be broadcast back through the wireless interface 230 by wireless means, or alternatively, may be read out through the hard wire interface 238 to, for example, a control board (not shown).

Another type of wireless operation of a CRUM is to have an initially detected wireless signal causes the controller 232 to make the memory 234 enter a "write mode." In other words, the initial wireless contact, such as a wireless signal of a predetermined type, may activate the controller 232 and cause the controller 232 to expect another wireless data stream through the wireless interface 230 within a predetermined time frame. This incoming wireless data may then be used to populate specific locations in the memory 234, such as, for example, to reset or adjust data parameters within the memory. For example, an initial wireless signal may be used to reset the various print counts in the memory to go back to zero or to some other predetermined number. This function would be useful for a remanufacturing process in which the remanufactured module 14 may once again be used to output a predetermined number of prints. Alternately, wireless means may be used to change or otherwise update special codes relating to what type of actions were taken on the module in a remanufacture process, for instance, such as whether a particular marking material supply module 14 was refilled.

Depending on certain considerations, such as cost, or the fact that a CRUM system is being retrofit into an existing model of printer, certain data may go in or out of the CRUM 200 through the wireless interface 230, or alternately through the hard wire interface 238. For example, the wireless operation of the various CRUMs may be on a very simple level, such that the detection of a suitable wireless signal on 230 may simply "unlock" the non-volatile memory 234 for writing therein, although the actual writing to memory 234 may take place through the hard wire interface 238.

Finally, the controller 232 may have provided therein an encryption key which will have the effect of permitting only those users having the encryption key to access the CRUM 200 via wired or wireless means. This feature may be useful for preventing unauthorized tampering with data in memory 234, such as to alter the print counts.

Figure 3:
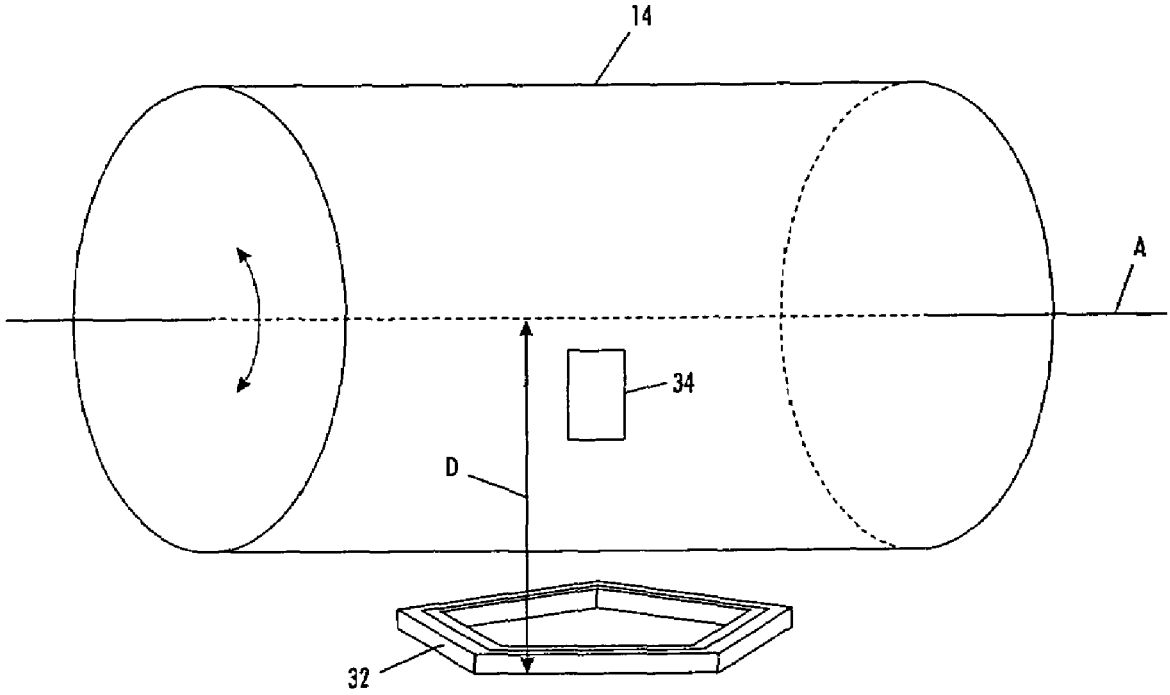
FIG. 3 is a diagrammatic representation of a wireless CRUM on a rotating CRU.

FIG. 3 shows an exemplary CRUM 34 on a rotating CRU, such as, for example the marking material supply module 14. As shown in FIG. 3, the CRUM 34 is wireless and affixed to a surface of the rotating marking material supply module 14. The rotating marking material supply module 14 rotates about an axis A. The wireless CRUM 34 is capable of communication with a transmitter and/or receiver 32 when it is within a communication distance D.

As readily inferred from FIG. 3, whenever the CRUM 34 is outside of communication distance D, the CRUM 34 may not be able to communicate with the transmitter and/or receiver 32. This may cause a number of problems. For instance, as discussed above, when the CRUM 34 is outside of the communication distance D, the CRUM 34 and the transmitter and/or receiver 32 must store data to be transmitted and/or received in, for example, a memory. Accordingly, the CRUM 34 and the transmitter and/or receiver 32 must have a relatively large memory. Second, the rotating marking material supply module 14 may be installed by a user such that the CRUM 34 is outside of the communication distance D. Thus, the device in which the rotating marking material supply module 14 is installed may, at least initially, operate without communicating with the CRUM 34. If the incorrect rotating marking material supply module 14 was installed, e.g., wrong color, wrong type, or wrong model the device will operate with that incorrect model until the CRUM 34 is rotated to within the communication distance D. Because, for example, such a rotating marking material supply module may rotate rather slowly, the incorrect rotating marking material supply module 14 may do substantial damage to the device or the device output before being recognized.

Figure 4:
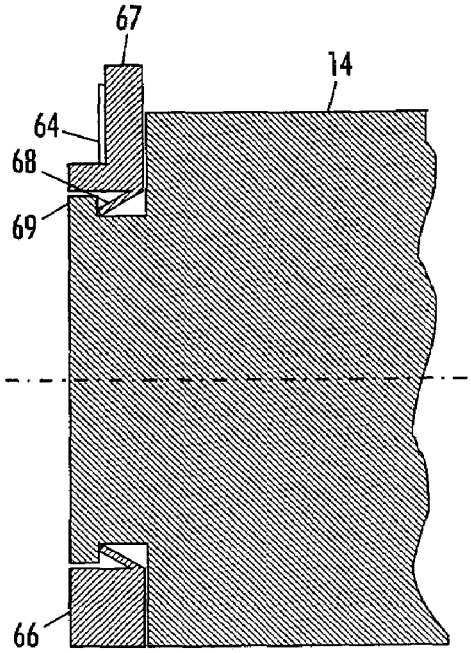
FIGS. 4 and 5 show an exemplary CRUM that may remain in contact with a transmitter and/or receiver throughout a complete rotation of the CRU.
Figure 5:
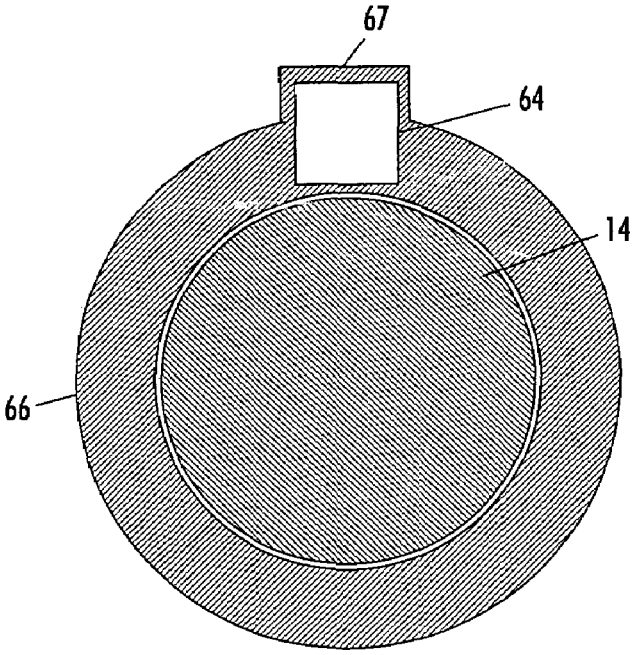

FIGS. 4 and 5 show an exemplary CRUM 64, which may be either wired or wireless, that may remain in communication with a stationary transmitter and/or receiver (not shown) throughout a complete rotation of the CRU, for example, the rotating marking material supply module 14. As shown in FIGS. 4 and 5, the CRUM 64 may be affixed to a cuff or sleeve 66 that is attached to the rotating marking material supply module 14. As used herein, the terms cuff and/or sleeve are not intended to describe any particular structure other than a structure that may be affixed to an outer surface of at least a portion of the CRU 14. The cuff 66 may be affixed to the CRU 14 such that the CRU 14 rotates while the cuff 66 remains stationary. For example, the cuff 66 may be attached to an end of the CRU 14 by a flexible tab 68 interacting with a ridge 69. The tab 68 may flex until the cuff 66 may be located onto the end of the CRU 14, beyond the ridge 69. Once the CRU 14 is beyond ridge 69, the tab 68 may resiliently return to substantially its original configuration, thereby securing the cuff 66 to the CRU 14 while allowing the CRU 14 to rotate. It should be appreciated that any securing, fixing, or attaching system or device may be used to temporarily or permanently secure, fix, or attach the cuff 66 to the CRU 14 as long as the CRU 14 is permitted to rotate independently of the cuff 66.

Because, as discussed above, the CRU 14 is permitted to rotate independently of the cuff 66, the CRUM 64 may remain stationary while the CRU 14 rotates. Thus, the CRUM 64 may easily remain within a desired communication distance of a stationary transmitter and/or receiver such that the CRUM 64 and the transmitter and/or receiver will be capable of communication while the CRU 14 rotates, regardless of the rotational position of the CRU 14. Thus, the amount of memory required for either the CRUM 64 or the transmitter and/or receiver may be reduced since data to be transmitted by and/or or received by the CRUM 64 may be communicated at any time. Furthermore, the CRUM 64 may always be within the substantially same location with respect to the transmitter and/or receiver. Thus, when a CRU 14 is replaced, the transmitter and/or receiver may communicate with the CRUM 64 to ensure that the CRU 14 is compatible with the device (e.g., correct color, correct type, and/or correct model) prior to operation, thereby preventing any damage that may be caused by installation of an incorrect CRU.

In order to ensure that the CRUM 64 is properly located within a communication distance of a transmitter and/or receiver, the cuff 66 may be provided with a locating feature 67, such as, for example, a protrusion, a rib, a notch, or any other shape or configuration that may correspond to a complementary locating feature (not shown) within the device. Thus, by matching the locating feature 67 of the cuff 66 on the CRU 14 and the locating feature of the device, the CRUM 64 may be properly located within a communication distance of a transmitter and/or receiver. Furthermore, the locating feature 67 may prevent rotation of the cuff 66 and thus inhibit or even prevent movement of the CRUM 64 relative to a transmitter and/or receiver.

As discussed above, some devices employ more than one CRU, for example, a separate rotating marking material supply module 14 for each color of marking material. Thus, each separate marking material supply module 14 may be provided with, for example, a differently shaped locating feature 67 on its respective cuff 66 matched to a corresponding differently shaped locating feature on the device. Because, each separate marking material supply module 14 may be provided with a differently shaped locating feature 67, a user may be prevented from, for example, mistakenly installing a rotating marking material supply module for one color in a location intended for a different color. The locating features of the different colored marking material supply modules may only be compatible with their respective corresponding locating feature on the device.

It should be appreciated that although FIGS. 4 and 5 show the cuff 66 fixable to the end of the rotating CRU 14, the cuff 66 may be fixed to a larger portion of the CRU 14, such as, for example, extending over at least a portion of a circumferential surface of the CRU 14. Thus, the CRUM 64 may be located on a circumferential surface of the cuff 66 fixed to the end of the rotating CRU 14. A transmitter and/or receiver may be located within a communication distance of such a circumferentially located CRUM 64.

The use of a cuff 66 is advantageous because it may allow the CRUM 64 to remain a fixed, controlled, and/or close distance from the rotating CRU. Many of the components within the CRUM 64, for example the transmitter/receiver 42 or a sensor (describe below) may require a that the CRUM 64 is a fixed, controlled, and/or close distance from the rotating CRU.

It should further be appreciated that, when the CRUM 64 is located on the stationary cuff 66 that allows the CRU 14 to rotate independently of the cuff 66, the CRUM 64 need not be wireless. As discussed above, according to such a configuration, the CRUM 64 and a transmitter and/or receiver are stationary, i.e., the CRUM 64 does not move relative to the transmitter and/or receiver. Accordingly, based on cost and or other design considerations, the CRUM 64 may be hard wired, or otherwise physically connected to the transmitter and/or receiver.

Figure 6:
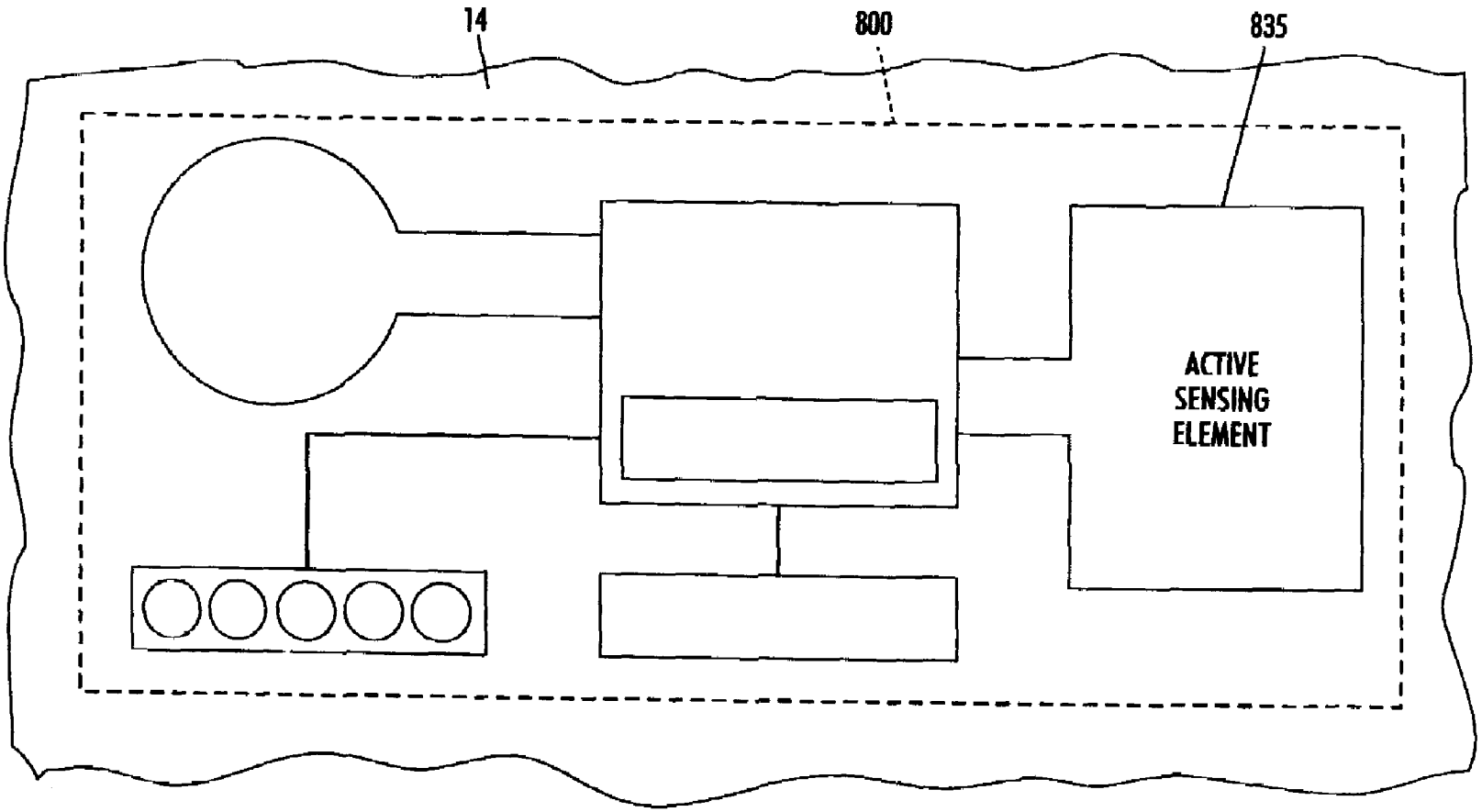
FIG. 6 is an example of a system that may inhibit associating an incorrect CRUM with a CRU.

FIG. 6 shows an exemplary system that may inhibit or even prevent a CRU with an incorrect CRUM from being installed in a device. Such may result from, for example, a wrong CRUM being affixed to a CRU during manufacture, or an incorrect cuff 66 being affixed to a CRU at the factory or by a user. FIG. 6 shows a exemplary CRUM 700 similar to the exemplary CRUM 200 of FIG. 2. Similar elements and features are incorporated herein and will not be described. As shown in FIG. 6, CRUM 800 may include at least one active sensing element 835. The active sensing element 835 may include, for example, a Hall effect sensor, and RF search coil, a capacitive proximity sensor, an electric field sensor, an optical sensor, or any other sensor capable of sensing at least one physical quality of a CRU or contents of a CRU. Accordingly, the active sensing element 835 may recognize the at least one physical quality of the CRU or contents of the CRU 14, and based on that information, the device (e.g., a controller within the device) may determine whether the CRUM 800 is properly associated with the CRU 14.

For example, a pattern of magnets may be fixed to the outside of a rotating marking material supply module 14 having the CRUM 800 affixed to the cuff. As a result, the pattern of magnets may rotate with the rotating marking material supply module 14, while the CRUM 800 and the cuff remain stationary. The pattern of magnets may be located such that during their rotation they pass beneath the active sensing element 835, such as, for example, a Hall effect sensor, which may detect the variation in a magnetic field caused by the magnets. According to this example, each different rotating marking material supply module 14 may have a different pattern of magnets. Thus, the active sensing element 835 may determine what type of rotating marking material supply module 14 the CRUM 800 is associated with and may inform the device. If the incorrect type of rotating marking material supply module 14 is associated with the CRUM 800, the device may be notified before any damage occurs (for example, an incorrect color of marking material being fed into a marking device module 16).

It should be appreciated that in an alternative configuration the CRUM may be attached to the rotating CRU and the magnet(s) may be attached to the non-rotating cuff in order to induce current within the CRUM. Also the CRUM may be attached to the rotating CRU and the magnet(s) may be attached to some other stationary body within the device in which the CRU is installed.

The active sensing element 835 may also be useful for determining other types of device failures such as a CRU's failure to rotate. For example, assume that the CRU's rotation was initiated by the device. If after a predetermined period of time, the active sensing element 835 does not sense, for example, passage of the magnetic pattern on the CRU 14, the device may assume that the CRU 14 is not rotating properly.

In another exemplary implementation, the active sensing element 835 may be an optical sensor that is capable of illuminating and/or sensing the optical properties of a material, for example, within an at least partially transparent or translucent rotating CRU 14. For example, a CRUM may be fixed directly to the surface of the CRU (e.g., FIG. 3) or may be fixed to the outside of a rotating marking material supply module having a CRUM affixed to a cuff or sleeve (e.g., FIGS. 4 and 5). The active sensing element 835 may then determine the color of, for example, marking material within the rotating CRU to ensure that the correct color is associated with the CRUM. Additionally, the active sensing element 835 may determine, for example, an actual amount of marking material remaining in the rotating marking material supply module.

In another exemplary implementation, the active sensing element 835 may be a magnetic sensor that is capable of sensing magnetic properties of a material within a rotating CRU. For example, a CRUM may be fixed directly to the surface of the CRU (e.g., FIG. 3) or may be fixed to the outside of a rotating marking material supply module having a CRUM affixed to a cuff or sleeve (e.g., FIGS. 4 and 5). Assuming that, for example, each color of marking material has a different amount of magnetic material, either inherent or added, the active sensing element 835 may then determine, for example, the strength and/or location of, for example, a magnetic field of the marking material within the rotating CRU to ensure that the correct color is associated with the CRUM. Additionally, the active sensing element 835 may determine, for example, an actual amount of marking material remaining in the rotating marking material supply module.

Thus, by including the active sensing element 835 in the CRUM 800, the CRUM 800 (or the device) may determine at least one property of the CRU 14 with which the CRUM 800 is associated, and may evaluate that property to help determine, for example, whether the CRUM 800 is associated with the correct CRU 14, and/or determine an operational status of the CRU 14. IT should be appreciated that the exemplary CRU 800 is applicable to both rotating and non-rotating CRUs.

Figure 7:
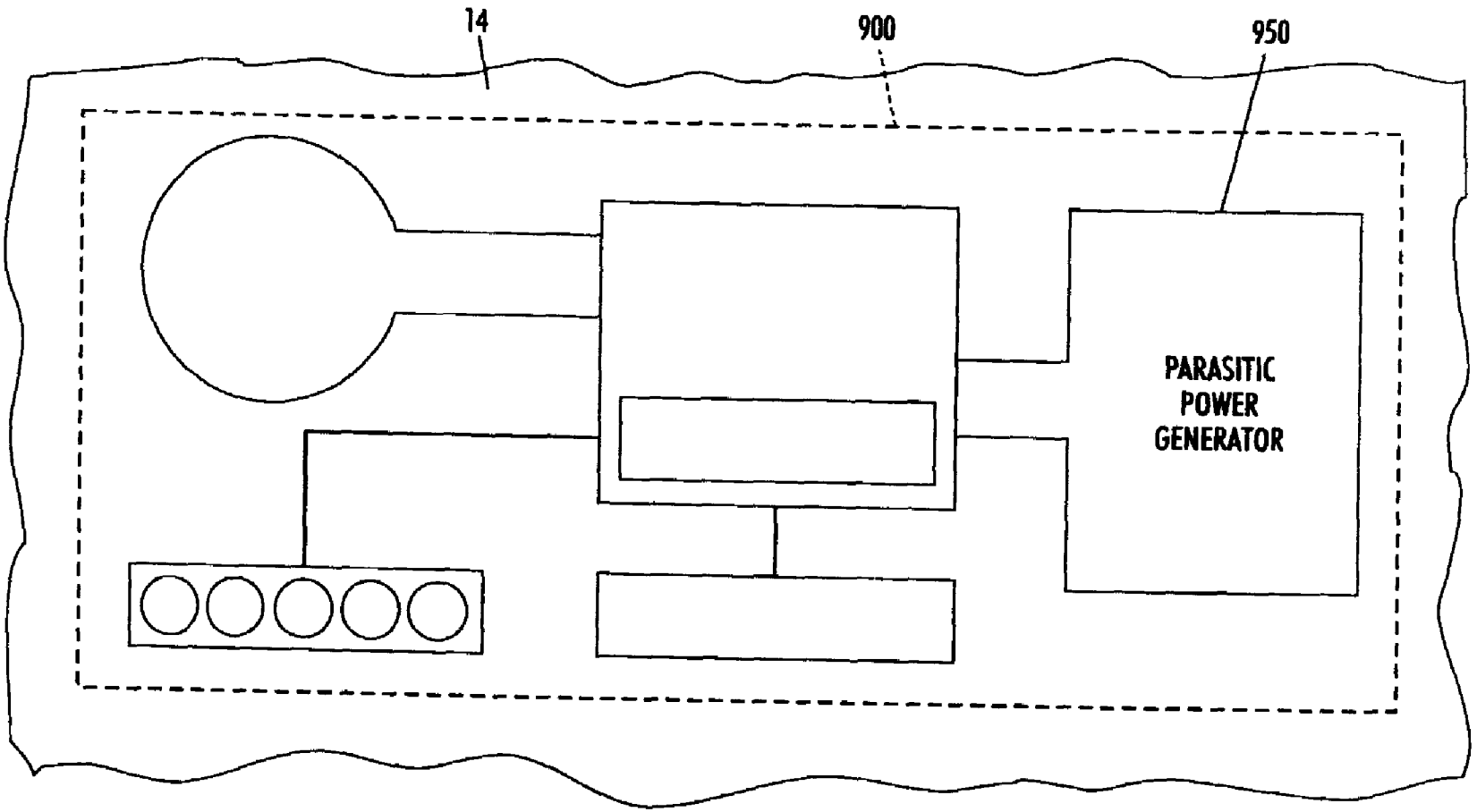
FIG. 7 shows an exemplary CRUM that may generate its own power.

It should be appreciated that the above exemplary system may enable a CRUM to record details of operation of the CRU without any power or communication with the host processor, printer, marking engine, etc. FIG. 7 shows a CRUM 900 with a parasitic power generator 950. The power generator may be, for example, a closed conductive loop. Then, for example, the passage of a series of magnets under the closed conductive loop, may induce an electric current within the loop according to Faraday's Law. The magnitude of the induced current may vary with the strength of the magnetic field, the area of the conductive loop, its angle with respect to the magnetic field, and the number of turns of the conductive loop. The resulting electric current may be sufficient to operate a low powered electronic device, and perform, for example, at least the function of recording the number of times the magnets pass under the conductive loop. Such a measurement may be recorded in the memory section of the CRUM 900, and subsequently may be read out from the memory section of the CRUM 900 when, for example, the CRU 14 itself is returned to a remanufacturing site.

As discussed above, in order to parasitically generate power, a single magnet or multiple magnets may be attached to the perimeter of a rotating CRU, and as discussed above with respect to FIG. 6, a sensor-equipped CRUM may be situated on a non-rotating cuff in such a way as to detect the passage of the magnet or magnets as the CRU rotates during normal operation. The passage of those magnets past the sensor-equipped CRUM may induce (according the principles above) a signal which may for example, power the CRUM's counting circuitry, and/or may cause the number of revolutions of the CRU to be recorded in CRUM memory. When the CRU is returned to the remanufacturing site, for example, the number of revolutions could be read out of the CRUM memory and, for example, a determination of the percentage of expected useful life of the photoreceptor may be obtained. Furthermore, this may be accomplished without any change to the architecture, software, wiring or performance or software of the host unit, since the CRUM is at least, self-powered and need not communicate with the host device. As a result, such a CRUM may be utilized on a CRU installed in a device that was not designed to be use CRUMs.

As used herein, the term "parasitic" refers to any type of power generation in which the device is not directly supplying power to the CRUM, e.g., via a wire. Instead, parasitic power is power generated from sources that exist within the device as byproducts of the device's function. For example power may be generated from various ambient light sources within the device by using a solar cell. For example, many devices include LEDs, lasers, document scanners, and other light generation sources. Parasitic power may be generated by any number of moving parts within the device by, for example fixing magnets to a part which would otherwise be moving or rotating due to the operation of the device and generating power using a closed conductive loop. Parasitic power may be generated by taking advantage of radiant heat or a thermal gradient within the device, from, for example, a fuser, a light source, or a transformer. Generally, parasitic power may be generated by taking advantage of any energy source, such as, for example, heat, light, kinetic energy, or otherwise that may exist due to the normal operation of the device.

Thus, it should be appreciated that the parasitic power generator may include, for example, one or magnets and a closed conductive loop, a solar cell which is exposed to some form of light within the device, a device that converts heat or a thermal gradient into power. It should further be appreciated that a solar cell power generator, a heat power generator, or a thermal gradient power generator, need not rotate in order to generate power. Thus, the CRUM may be placed on a non-rotating CRU or a non-rotating portion of a rotating CRU.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles. g Co-pending U.S. Pat. Nos. 7,146,112 and 7,062,181, and U.S. Patent Publication Nos. 2006-0133609, 2006-0179391, 2006-0133831, 2006-0132287, 2006-0136989 and 2006-0133828 are herein incorporated by reference in their entirety.

FIG. 6 shows an exemplary system that may inhibit or even prevent a CRU with an incorrect CRUM from being installed in a device. Such may result from, for example, a wrong CRUM being affixed to a CRU during manufacture, or an incorrect cuff 66 being affixed to a CRU at the factory or by a user. FIG. 6 shows a exemplary CRUM 800 similar to the exemplary CRUM 200 of FIG. 2. Similar elements and features are incorporated herein and will not be described. As shown in FIG. 6, CRUM 800 may include at least one active sensing element 835. The active sensing element 835 may include, for example, a Hall effect sensor, and RE search coil, a capacitive proximity sensor, an electric field sensor, an optical sensor, or any other sensor capable of sensing at least one physical quality of a CRU or contents of a CRU. Accordingly, the active sensing element 835 may recognize the at least one physical quality of the CRU or contents of the CRU 14, and based on that information, the device (e.g., a controller within the device) may determine whether the CRUM 800 is properly associated with the CRU 14.

It should be appreciated that the above exemplary system may enable a CRUM to record details of operation of the CRU without any power or communication with the host processor, printer, marking engine, etc. FIG. 7 shows a CRUM 900 with a parasitic power generator 950. Exemplary CRUM 900 is similar to the exemplary CRUM 200 of FIG. 2. Similar elements and features are incorporated herein and will not be described. The power generator may be, for example, a closed conductive loop. Then, for example, the passage of a series of magnets under the closed conductive loop, may induce an electric current within the loop according to Faraday's Law. The magnitude of the induced current may vary with the strength of the magnetic field, the area of the conductive loop, its angle with respect to the magnetic field, and the number of turns of the conductive loop. The resulting electric current may be sufficient to operate a low powered electronic device, and perform, for example, at least the function of recording the number of times the magnets pass under the conductive loop. Such a measurement may be recorded in the memory section of the CRUM 900, and subsequently may be read out from the memory section of the CRUM 900 when, for example, the CRU 14 itself is returned to a remanufacturing site.

What is claimed is:

1. A system for monitoring a replaceable component of a device, comprising:

a wireless monitor located on the replaceable component, comprising:

a controller;

a memory; and a sensor that senses at least one property of the replaceable component;

wherein the replaceable component of the device comprises a non-rotating portion and a rotating portion.

2. The system of claim 1, wherein the device comprises a marking device.

3. The system of claim 1, wherein the system comprises a first communicator that communicates with a second communicator in the device.

4. The system of claim 1, wherein the first communicator communicates with the second communicator via a structural connection.

5. The system of claim 1, wherein the at least one property of the replaceable component is related to a property of marking material within the component.

6. The system of claim 1, wherein the replaceable component of the device comprises: a non-rotating portion; and a rotating portion, the non-rotating portion being fixed to the rotating portion, and the monitor being located on the non-rotating portion.

7. The system of claim 6, wherein the non-rotating portion comprises a first locating feature that corresponds to a second locating feature within the device.

8. The system of claim 7, wherein the first locating feature inhibits rotation of the non-rotating portion.

9. The system of claim 7, wherein a shape of the locating feature is based on a contents of the replaceable component.

10. The system of claim 1, wherein the monitor further comprises a parasitic power generator.

11. A system for monitoring a replaceable component of a device, comprising:

a wireless monitor located on the replaceable component, comprising:

a controller;

a memory; and a first communicator that communicates with a second communicator in the devices;

wherein the controller determines, based on a communication between the first communicator and the second communicator, whether the replaceable component is compatible with the device; and wherein the replaceable component of the device comprises a non-rotating portion and a rotating portion.

12. The system of claim 11, wherein the replaceable component of the device comprises: a non-rotating portion; and a rotating portion, the non-rotating portion being fixed to the rotating portion, and the monitor being located on the non-rotating portion.

13. A method of monitoring a replaceable component of a device, comprising:

locating a wireless monitor on the replaceable component, the monitor comprising: a controller; a memory; and a first communicator that communicates with a second communicator in the device;

and determining, based on the communication, whether the replaceable component is compatible with the device; and wherein the replaceable component of the device comprises a non-rotating portion and a rotating portion.

14. The method of claim 13, w herein communicating with the first communicator comprises communicating with the first communicator after the replaceable component is installed and before the replaceable component is rotated.

15. The method of claim 1, further comprising: sensing, with a sensor of the monitor, at least one property of the replaceable component; and determining, based on the at least one sensed property, whether the replaceable component is compatible with the device.

16. The method of claim 13, further comprising: sensing, with a sensor of the monitor, at least one property of contents of the replaceable component; and determining, based on the at least one sensed property, whether the replaceable component is compatible with the device.

17. The method of claim 13, wherein: sensing, with a sensor of the monitor, at least one property of contents of the replaceable component; and determining, based on the at least one sensed property, an amount of the material within the replaceable component.

18. A method of monitoring a replaceable component of a device, comprising:

locating a wireless monitor on the replaceable component, the monitor comprising: a controller; a memory; and a sensor; and sensing, with the sensor, at least one property of contents of the replaceable component; wherein the replaceable component of the device comprises a non-rotating portion and a rotating portion.

19. The method of claim 18, further comprising: generating power with a parasitic power generator.

* * * * *